United States Patent [19]

Kristy

[11] Patent Number: 4,568,998

[45] Date of Patent: Feb. 4, 1986

[54] ELECTRONIC CODE CONTROLLED DEADBOLT

[76] Inventor: Brickton D. Kristy, 515 Ocean Ave. Apt. 608 S., Santa Monica, Calif. 90402

[21] Appl. No.: 581,961

[22] Filed: Feb. 21, 1984

[51] Int. Cl.[4] ..... H01H 47/32

[52] U.S. Cl. ..... 361/172; 70/278; 340/825.31

[58] Field of Search ..... 361/171, 172; 307/10 AT; 340/825.31, 345; 70/278, 280

[56] References Cited

U.S. PATENT DOCUMENTS

| | | | |
|---|---|---|---|
| 3,733,861 | 5/1973 | Lester | 70/278 X |
| 3,854,310 | 12/1974 | Paull et al. | 70/280 |
| 4,083,424 | 4/1978 | Von Den Stemmen et al. | 70/278 X |
| 4,317,157 | 2/1982 | Eckloff | 361/172 |
| 4,366,466 | 12/1982 | Lutz | 361/172 X |
| 4,509,093 | 4/1985 | Stellberger | 361/172 |

FOREIGN PATENT DOCUMENTS

| | | | |
|---|---|---|---|
| 2324392 | 12/1974 | Fed. Rep. of Germany | 361/172 |
| 2911828 | 10/1980 | Fed. Rep. of Germany | 361/172 |
| 2480841 | 10/1981 | France | 70/280 |

*Primary Examiner*—Reinhard J. Eisenzopf
*Attorney, Agent, or Firm*—William H. Maxwell

[57] ABSTRACT

An electronic lock system for power positioning of a deadbolt, responsive to passive code combinations of tone frequencies imposed upon a radio frequency carrier wave, the code combinations being encoded and decoded with direct activation of switching to control operation of a motor drive for closed and opened positioning of said deadbolt.

25 Claims, 9 Drawing Figures

ELECTRONIC CODE CONTROLLED DEADBOLT

BACKGROUND OF THE INVENTION

This invention relates to deadbolts or locks for securing doors and the like, and will be disclosed herein in its adaptation to automobile doors and subject to the operation of that type of vehicle. It is a general object of this invention to provide security, and for example to prevent access or "breaking of the close" and alternately to permit access for ingress and egress. Heretofore, most locks have been key operated or combination operated, with mechanical limitations on key distinction and/or combination, and consequently subject to insecurity. That is, lock tumbler positioning can be determined by outsiders, or thieves and the like, and pass keys are available; all to the end that mechanical lock security is restricted and not entirely reliable. A state of the art locking device of the type under consideration utilizes electronics for the release of a deadbolt, as disclosed in U.S. Pat. No. 3,733,861 issued to Robert W. Lester May 23, 1973 and entitled Electronic Recognition Door Lock, wherein a transponder transmits a range of ultrasonic signals of varying frequency, which equal a code sequentially both in time length and frequency. The three sequential timed signals are received by transducers and transmitted to a shift register that activates a bolt releasing solenoid, only after signals are received in the proper sequence. The Lester system is feasible but is unecessarily complicated and restrictive through its indirect mode of operation, and therefore not entirely practical. Accordingly, it is an object of this invention to provide an improved electronic security system having a direct mode of operation over locked devices and closures, whereby the lock closing and opening combinations are not only unpredictable but are substantially increased in number of combinations available for greater security; each combination herein being distinctly a "passive code".

State of the art electronics and electric actuation and control apparatus as well as a power source therefor are all extremely reliable and the operation thereof predictable. It is an object therefore to employ electronics and its associated means of employment as a securement where locks and the like are usually employed. With the present invention, passive electronic coding replaces sequentially timed coding and mechanical devices and/or combination means, greatly simplifying and substantially increasing reliability and the finite choice of so-called opening combinations. As will be described, one or more and preferably a plurality of frequencies in the form of a passive code are simultaneously encoded and decoded, each frequency referred to herein as a "tone" which may extend beyond human hearing and distinct frequencies thereof selected within bands at close intervals for finite coding.

An actively occupied dwelling or vehicle can be expected to have a readily available and reliable power source, namely electrical power. It is therefore and object of this invention to employ available electrical power as the force to exclusively operate the electronics and motivation of the lock or deadbolt as it is disclosed herein. The wiring and control unit installations are readily secreted so as to be inaccessible to the would-be intruder, and operational reliability is ensured by readily available high quality electronics and associated electrical components installed in a tamperproof manner. Accordingly, the system of the present invention is entirely electronic and/or electrical and in no instance can the circuits be preempted and the lock or deadbolt defeated.

The operation of a lock involves closing and opening, and since this invention is concerned particularly with exclusive electrical actuation, both the closing and opening modes of operation are controlled thereby. Therefore, it is an object of this invention to provide distinct opening and closing codes, to provide cooperative encoding and decoding of both codes, and all of which is associated with control switching of motor means by which the lock or deadbolt is driven to a closed or an opened position.

Safe operation of a vehicle requires door egress at any time, for example in case of an emergency. Therefore, it is an object of this invention to preempt the locking condition through the vehicle operation; and in this disclosure by the actuation of the auto ignition switch to the "ON" position. Thus, while the vehicle is operating, the deadbolt is maintained in the opened condition, and alternately when the vehicle is out of operation and the ignition switch "OFF", the deadbolt is conditioned so that it can be closed. Opening is assured by the ignition switch being "ON", while closing is passive and permitted by the ignition switch being "OFF".

It is also an object of this invention to provide for any failure of the deadbolt penetration into the bolt hole or door jamb. To this end, a pressure sensing means is proivded which is associated with control and limit switches that cooperate with the decode switch as will be described.

SUMMARY OF THE INVENTION

This invention is concerned with an electronic clocking device that is power operated, and is characterized by producing a passive code comprised of a plurality of tone signals that are simultaneously encoded and decoded. The choice of tone frequencies available from a wide range of finite tones is imposed upon designated and lawful carrier wave frequency for radio transmission, and used for remote or outside control of the locking device. A feature of this invention is the concealment and inaccessibility of the active components involved, and this necessitates automation in the form of a motor driven deadbolt. In practice, the deadbolt is motor driven into closed and opened positions, and to this end there are distinct code combinations for each of said positions. A major use of this deadbolt system is for automotive security, in which case positioning of the deadbolt is cooperatively associated with operation of the vehicle by conditions imposed by the vehicle ignition switch to preempt closing of the deadbolt. An anti-jam feature is included to prevent damage in the event of incomplete door closure or other obstruction preventing proper operation of the deadbolt. When activated, this feature causes the deadbolt to abandon its attempt to occupy the closed position and returns it to the opened position.

The foregoing and various other objects and features of this invention will be apparent and fully understood from the following detailed description of the typical preferred forms and applications thereof, throughout which description reference is made to the accompanying drawings.

Figure 4:
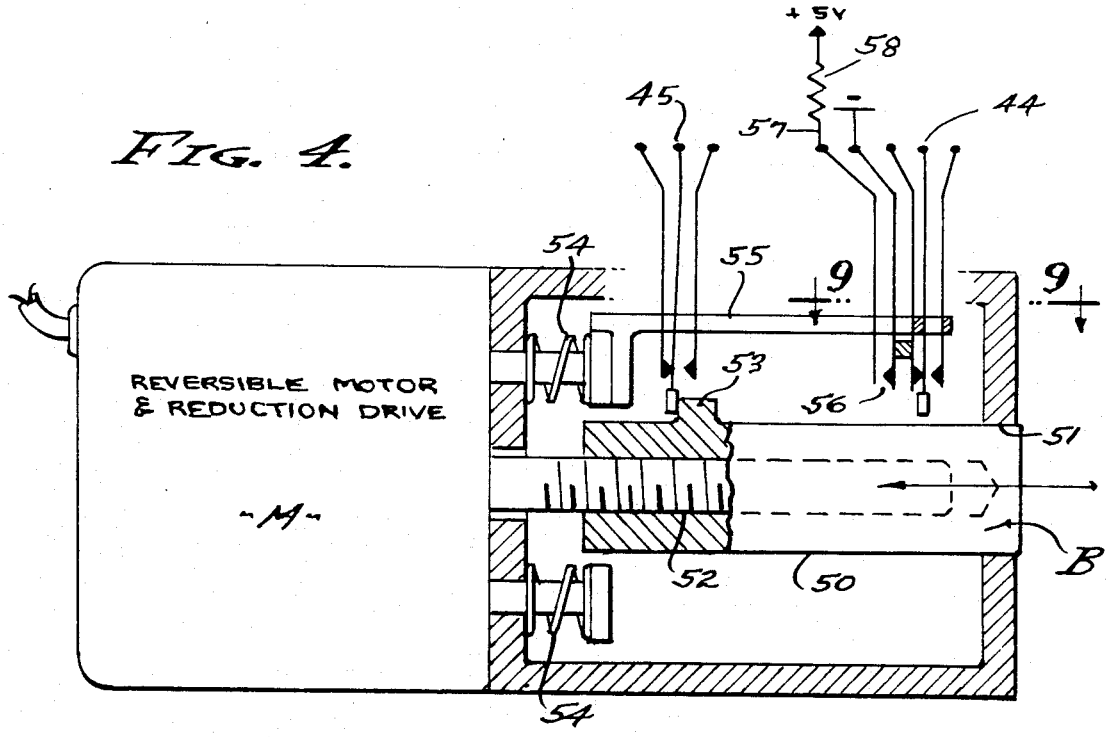
FIG. 4 is an enlarged detailed sectional view of the motorized deadbolt drive showing the force sensing means and the limit switches associated therewith.
Figure 9:
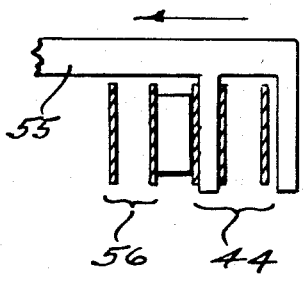

And, FIG. 9 is an enlarged detailed fragmentary view taken as indicated by line 9—9 on FIG. 4.

PREFERRED EMBODIMENT

Figure 1:
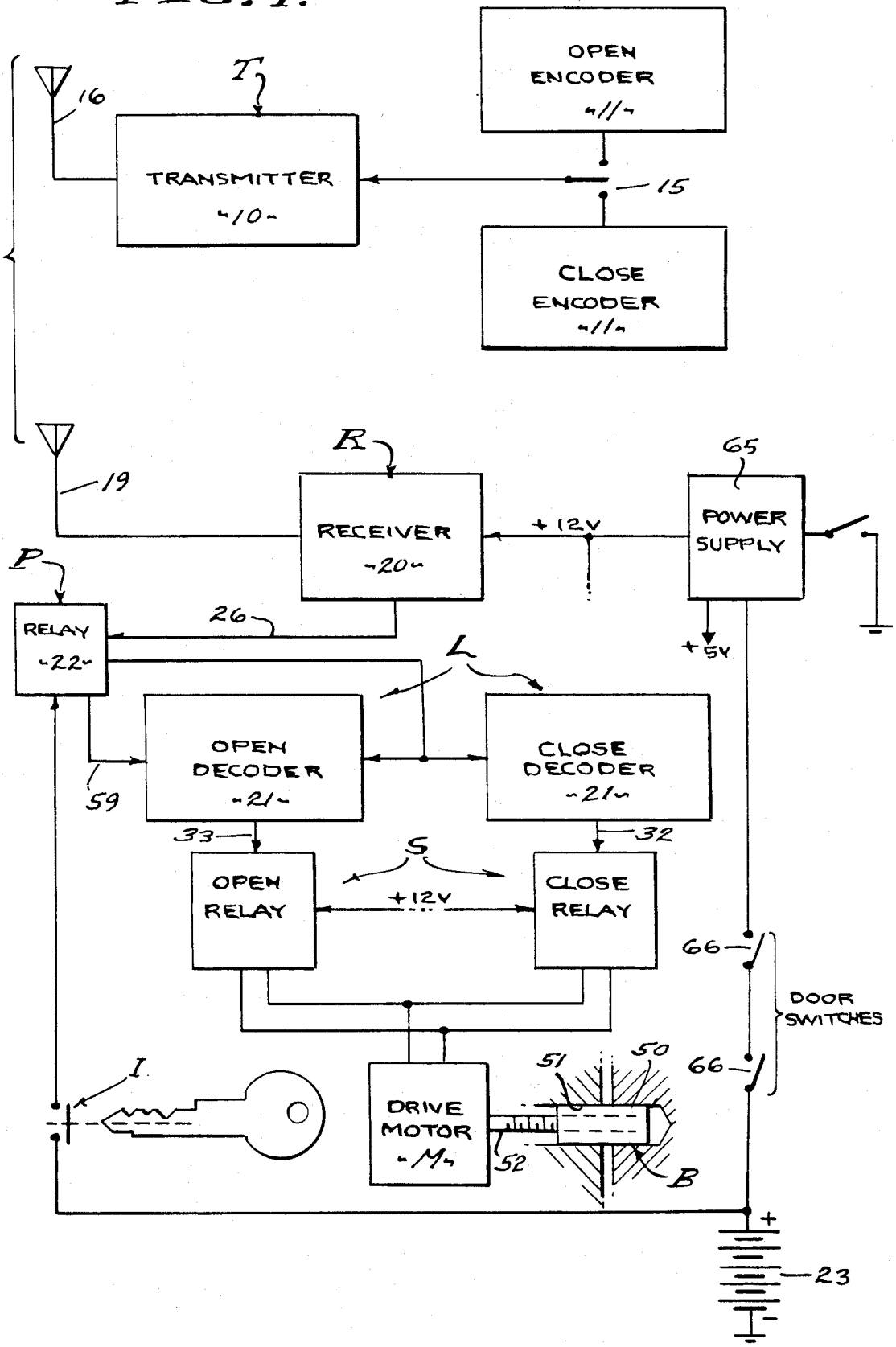
FIG. 1 is a block diagram showing the electronic code controlled deadbolt system of the present invention, characterized by a transmitting encoder and a receiving decoder.

Referring now to FIG. 1 of the drawings, the electronic lock and/or deadbolt system of the present invention involves, generally, a transmitter T to send encoded "close" and "open" signals, a receiver R to receive the "close" and "open" signals, a logic means L to produce "close" and "open" circuit conditions that operate switch means S to control operation of a motor M driving a bolt B between "close" and "open" positions. In automotive applications of this device or system there is preempting means P to shift the bolt B to the "open" position by closing the vehicle ignition switch I. The transmitter T is a remote or outside control means that is portable and adapted to be personally hand carried and operated as a unit. The receiver R, logic means L and switch means S are installed as a unit in a secure and inaccessible place within the dwelling or vehicle, or other place of security in any construction to be secured. And, the bolt B and drive motor M are inaccessibly installed as a unit within the door structure to be secured. It is to be understood that inaccessiblity is attained when the door is closed and locked by the system.

Figure 2:
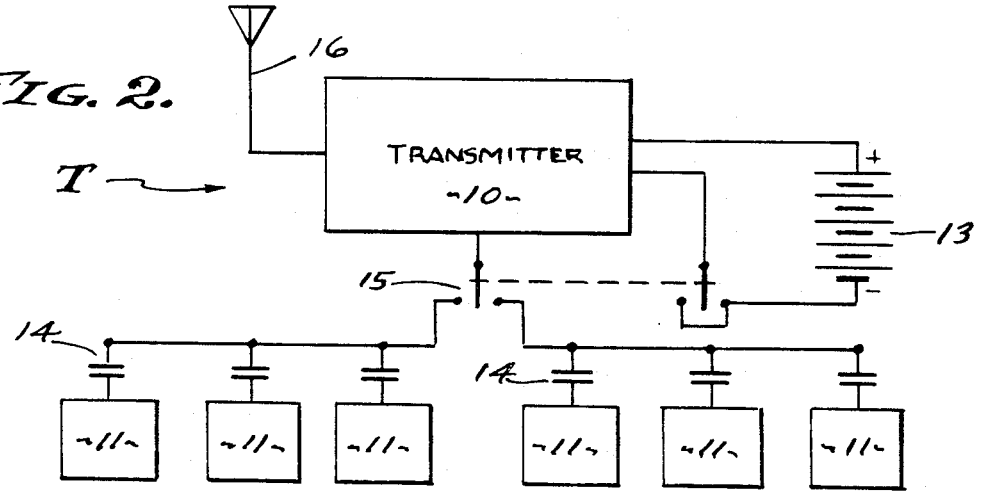
FIG. 2 is a schematic diagram of the transmitting encoder, showing a first embodiment thereof.

The transmitter T is the code key element or encoder of this system and is a battery operated radio control unit comprised of a radio transmitter means 10 coupled to at least one and preferably a plurality of tone generator means 11. The transmitter T is activated by a push button or toggle switch 15 in a circuit from a battery 13. The transmitting frequency is for example 27 MHz, and the tone generating means 11 can produce any frequency within a tone range adapted to be transmitted by the transmitting frequency carrier wave. As shown in FIG. 2 there are three tone generating means 11 for the "close" condition, and there are three tone generator means 11 for the "open" condition, each simultaneously producing a distinct tone frequency for radio transmission in the form of a composite code. In practice, Type 555 IC Timers as supplied by Radio Shack are employed as each generator means 11, and which are coupled by capacitors 14 to the transmitter means 10 through a selector switch 15. The 555 IC Timer is a highly stable device for generating accurate time oscillation. For astable operation as an oscillator, the free running frequency and duty cycle are accurately controlled with two external resistors and one capacitor. Accordingly, each group of three generator means 11 is capacitor coupled to the transmitter means 10, and all of which is actuated by the double throw double pole selector switch 15 to momentarily transmit a passive combination of tone frequencies in the form of a distinctive "close" or "open" code signal.

Figure 3:
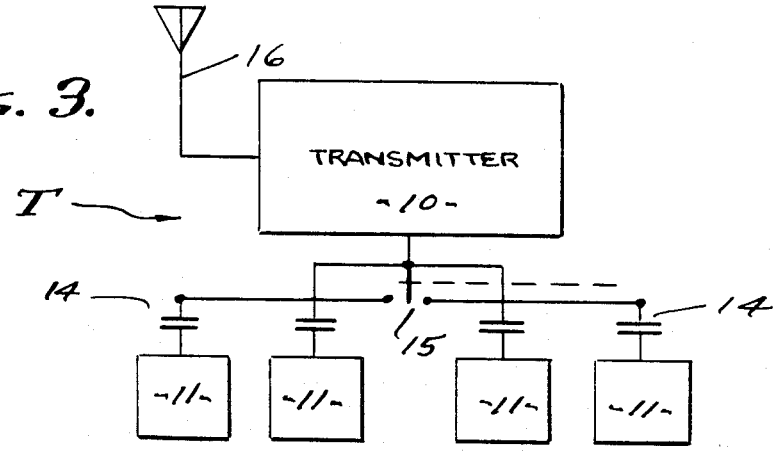
FIG. 3 is a view similar to FIG. 2 showing a second embodiment thereof.

Alternately from the tone generator arrangement described above and as shown in FIG. 3, the plurality of tone frequencies is established by providing one tone generator 11 in excess of the number of tones required in the composite code, and by alternately selecting either one of two of said generator means 11 with the selector switch 15, to be operative with at least one other of said tone generators 11. As shown, two generators 11 remain in circuit while a pair of tone generators 11 are alternately selected to change the code combination. A feature is the direct application of frequencies and simultaneous transmission thereof from an antenna 16 as and when desired.

Figure 5:
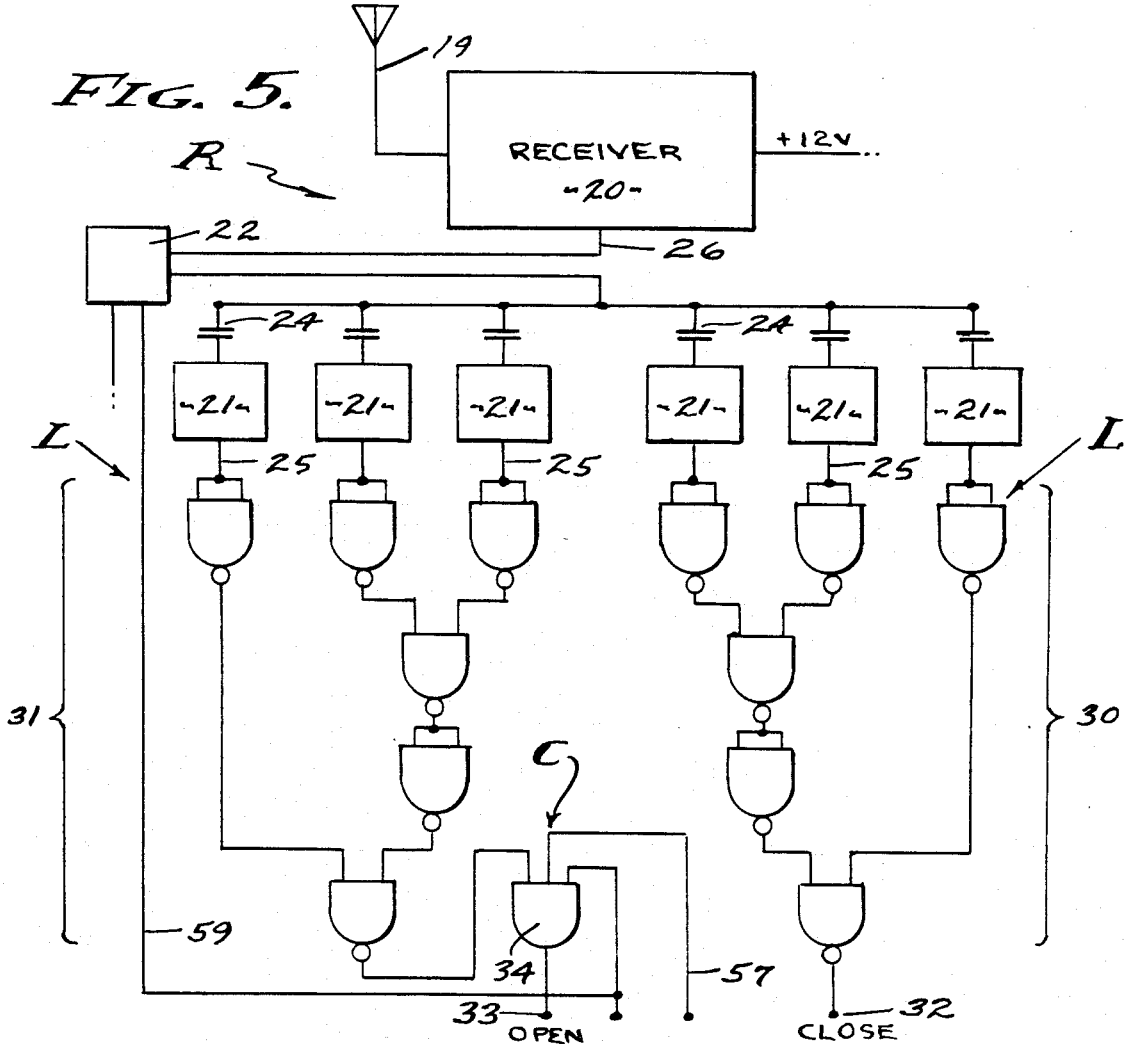
FIG. 5 is a schematic diagram of the receiving decoder, showing a first embodiment thereof.

The receiver R is the code responsive element or decoder of this system and is a powered radio control unit comprised of a radio receiver means 20 coupled to at least one and preferably a plurality of tone decoder means 21. The receiver R is activated by a + 12 v power supply shown as a battery 23, and it receives the aforementioned "close" and "open" signals through an antenna 19. A preempt control means P is shown as a relay switch 22 actuated by the vehicle ignition switch I. The receiving frequency is the same as the aforementioned transmitting frequency, for example 27 MHz, and each decoder means 21 is tuned to and is thereby responsive to a distinct tone frequency so as to produce a low "0" at each output 25. A plurality of decoder means 21 each having a distinct tone response are combined to establish a code signal to be passed for activating a "close" or "open" signal. As shown in FIG. 5 there are three tone decoder means 21 for the "close" condition, and there are three tone decoder means 21 for the "open" condition, each simultaneously receptive to a distinct tone frequency from the radio receiver 20, so that each group of decoder means 21 is receptive to a composite code signal. In practice, Type 567 IC Decoders as supplied by Radio Shack are employed as each decoder means 21, and which are coupled by capacitors 24 to the receiver means 20 through conductor 26. The 567 IC Tone Decoder is a general purpose decoder designed to provide a saturated transistor switch to ground when an input signal is present within the passband. The IC circuit consists of an I and Q detector driven by a voltage controlled oscillator which determines the center frequency of the decoder. External components are used to independently set center frequency of each decoder band width and any output delay. Accordingly, each group of three decoder means 21 is capacitor coupled to the receiver means 20, and each is responsive to a distinct tone frequency and goes low "0" at its output 25 when said frequency is received thereby. When all decoder means 21 respond and go to low "0" a complete code signal is present and responded to at all outputs 25.

The logic means L is provided to respond to the simultaneous high and low outputs of the decoder means 21 and in this instance separate "close" or "open" logic circuits in the form of OR-gate 30 and 31. As shown in FIG. 5, each OR-gate is a three input gate responsive to the outputs 25 of three decoder means 21. The "close" OR-gate 30 and the "open" OR-gate 31 are alike and each comprised of NAND-gates arranged in a network so that one or more highs at outputs 25 caused the outputs (32 or 33) of the OR-gates to go high +5 v. However, when all three of the outputs 25 go low "0" then the outputs (32 or 33) go low "0". Accordingly, each OR-gate 30 or 31 responds to recognized code signals only when decoded by all three decoder means associated therewith through outputs 25. Since but one code signal is transmitted at a time by transmitter T, only one receptive code can be decoded at a time and processed by the logic of means L. Therefore, a momentary presence of a "close" or "open" signal will appear in the form of a low "0" at output 32 or 33.

Figure 6:
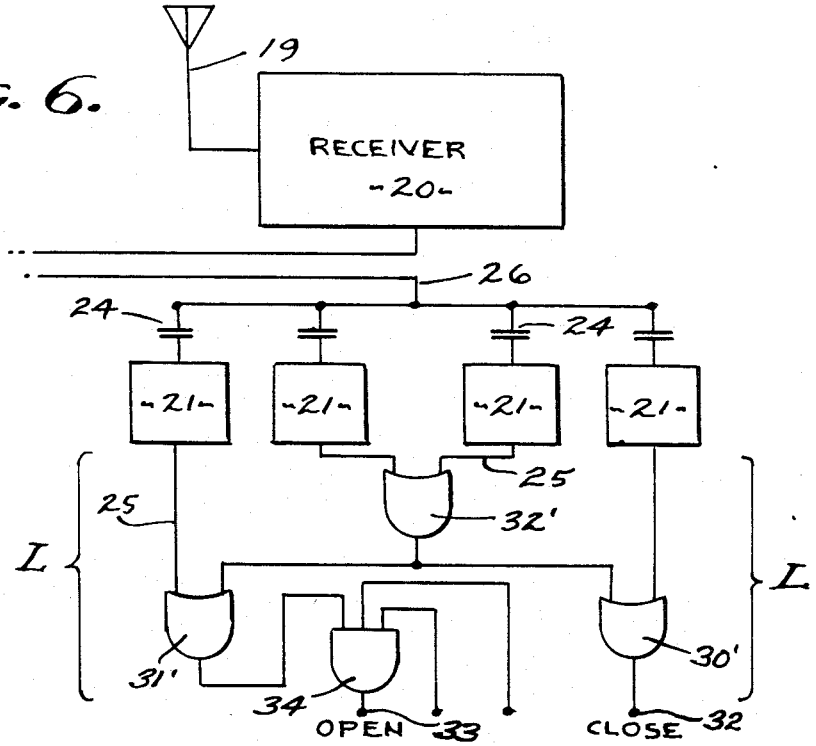
FIG. 6 is a view similar to FIG. 5 showing a second embodiment thereof.
Figure 7:
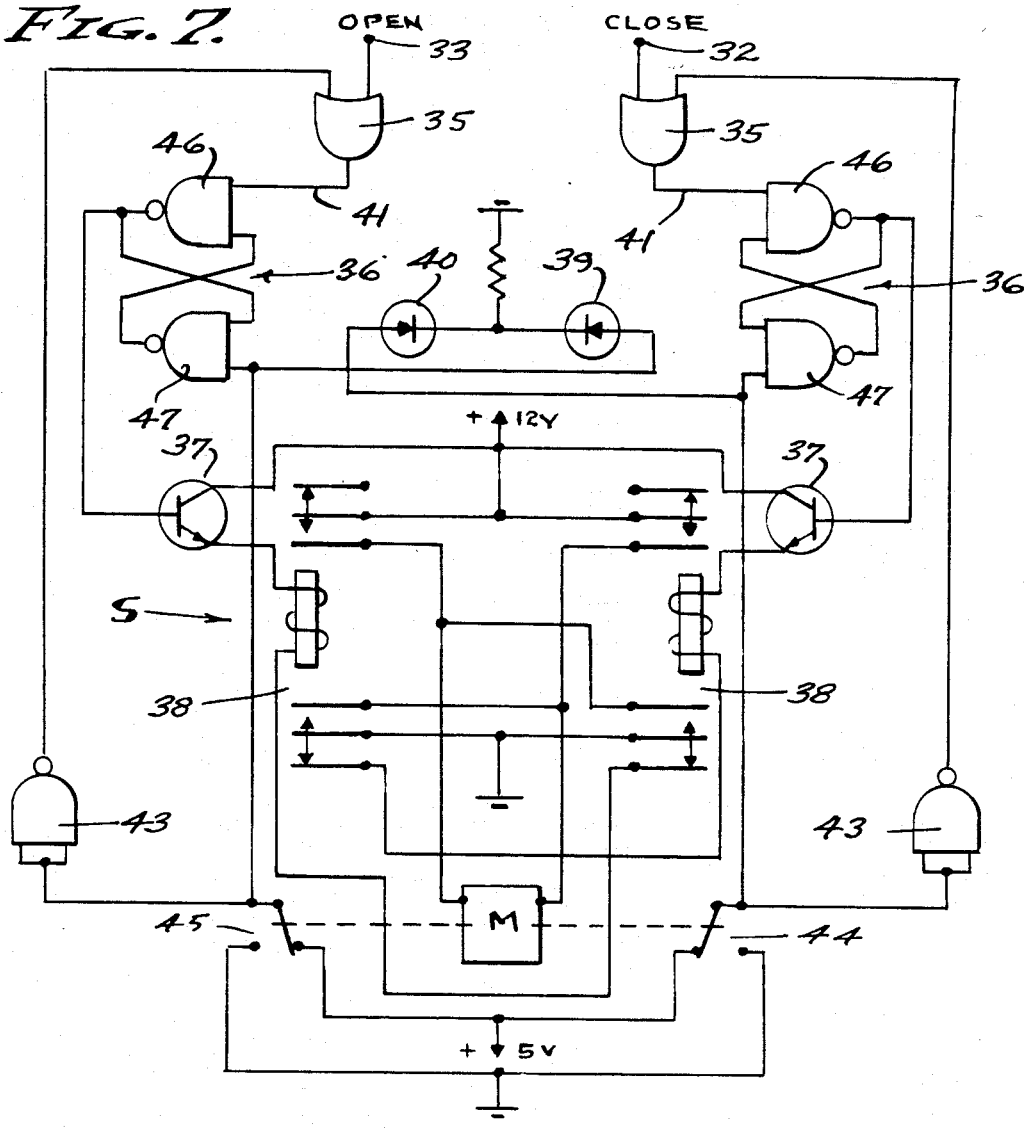
FIG. 7 is a schematic diagram of the logic and relay circuitry that is responsive to the decoder of FIG. 5 or 6.
Figure 8:
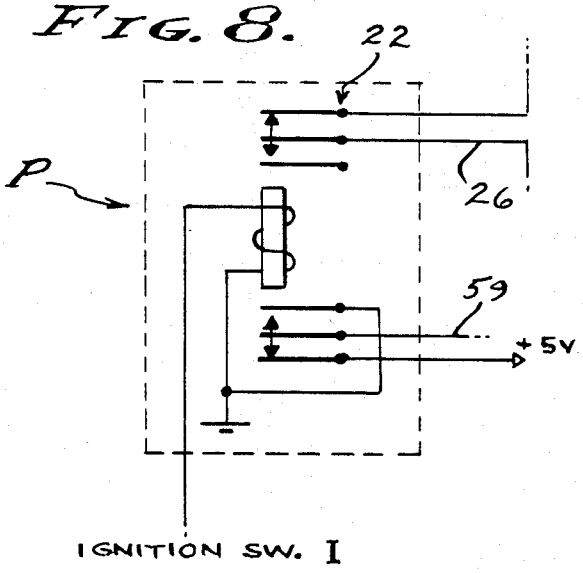
FIG. 8 is a schematic diagram of the relay shown in FIG. 1 and that is responsive to the ignition switch.

Alternately from the decoder arrangement described above and as shown in FIG. 6, the plurality of responsive frequencies is established by providing one tone decoder means 21 in excess of the number of tones required to be responded to in the composite code signal, and associated with a network of OR-gates 30', 31' and 32' operable to distinguish between "close" and "open" code signals. As shown, OR-gate 30' has one input from one decoder means 21 responsive to one frequency of the "close" code signal, while the OR-gate 31' has one input from one decoder means 21 responsive to one frequency of the "open" code signal. The other inputs of each OR-gate 30' and 31' are from the output of OR-gate 32' that has distinguishing inputs from two decoder means 21 and both responsive to "close" and "open" code signals. Accordingly, each OR-gate 30' and 31' responds to a recognized code signal only when decoded by a predetermined pair of decoder means 21, thereby presenting a momentary low "0" at output 32 or 33.

In accordance with this invention, the deadbolt B is assured of being operated to the "open" position under certain conditions by a signal mode conditioning means C associated with the OR-gate 31 (31') of logic means L. In addition to responding to the logic output of OR-gate 31, the mode conditioning means C also responds to the "ON" condition of the ignition switch I, and also to the "ON" condition of a pressure sensing means P responsive to "close" operating pressure applied in excess to the deadbolt. As shown, means C is comprised of a three input AND-gate 34 wherein all inputs are normally high +5 v and the output 33 high +5 v. In the event of any one of the aforementioned conditions going low "0" to one or more of the inputs, the output at 33 goes low "0" thereby providing an "open" signal.

The switch means S is provided to respond to either a "close" or "open" condition momentarily present at the outputs 32 or 33, so that a low "0" at output 32 will cause "close" switching to motor M, and so that a low "0" at output 33 will cause "open" switching to motor M. Since the "close" and "open" signals are momentary, switch means S is characterized by a two channel relay means and each channel comprised of an input OR-gate 35, a latching circuit or latch logic means 36, a transistor switch 37, and a latching relay 38. Included in the switch means S are indicator lights or LED's 39 and 40 to show the position of the deadbolt; closed, traveling or open.

The double input OR-gate 35 has an output 41 that sets the latch logic means 36. One input is from the OR-gate output 32 (33) and is normally high +5 v, and the other input from the inverted output of a NAND-gate 43 in circuit from a single pole double throw limit switch 44 (45) is normally low "0". Limit switch 44 is normally closed to +5 v and goes to negative when the deadbolt reaches a closed position, while limit switch 45 is normally closed to +5 v and goes negative when the deadbolt reaches an opened position. The NAND-gate 43 supplies a low "0" when supplied with +5 v from switch 44 (45), so that a low "0" appears at the input of OR-gate 35, and with the result that a low "0" from the logic means output 32 (33) produces a low "0" to set the latch logic means 36. Alternately, when the limit switch 44 (45) goes to negative the condition is reversed to +5 v at the OR-gate 35 so as to avoid two lows "0" at the latch logic means 36 inputs when it is released by a low "0" imposed on the one input thereof from limit switch 44 (45) thereby releasing said latch circuit.

The latch logic means 36 is comprised of a pair of NAND-gates 46 and 47 responsive to set with a low at the input of one and a high at the input of the other. Each gate has two inputs with the output of one connected to the input of the other. The primary purpose of latch logic means 36 is to turn "ON" the transistor switch 37 and thereby set the latching relay 38 in an "ON" condition, and accordingly the output of NAND-gate 46 goes to the base of the transistor switch 37. Consequently, a low "0" from output 32 (33) of logic means L sets the latch logic means 36 and produces a +5 v to transistor switch 37. The condition is reversed by limit switch 44 (45) whereupon the latch logic means 36 is released to drop the transistor switch 37.

A latching relay 38 is set and released by each channel transistor switch 37 as controlled by the aforesaid latch logic means 36, and limit switches 44 and 45. In accordance with this invention there is a double pole double throw relay 38 for each mode of motor operation; forward rotation to "close" and reverse rotation to "open". One pole of each relay is negative while the other pole is positive, and both poles being normally open in a circuit to the motor M which is shown as a reversible D.C. motor. The contacts of one relay 38 are connected to motor M for forward rotation while the contacts of the other relay 38 are connected to motor M for reverse rotation. Also, the magnet winding of one relay 38 is connected to a normally closed contact of the other relay 38, in each instance. Consequently, one relay can be activated only when the other relay remains inactive, only one relay 38 being operable at any one time. A normally open or passive condition of switches 44 and 45 and of relays 38 is shown in the drawings. However, it is to be understood that in actual practice and in operation of the deadbolt, see FIG. 4 for example, the one switch 44 will be actuated to +5 v while the other switch 45 will be actuated to negative, or vice versa, at either end of motor operation.

There are two automatic retraction functions provided by this invention, the first of which is mechanical and associated with force applied to close the deadbolt, and the second of which is electrical and associated with ignition or the like which enables vehicle operation. The purpose herein is to ensure that closing of the deadbolt does not occur if the deadbolt is obstructed, nor when the vehicle is mobile or in operation.

Concerning the first mentioned mechanical retraction function, the deadbolt 50 is slideably carried in a guide 51 to be transported between "close" and "open" positions by a screw 52 reversibly rotated by the motor M. A lug or shoulder 53 on the bolt is engageable with a moveable element of either limit switch 44 or 45 when reaching the "close" or "open" positions at the end of transport, as hereinabove described. The motor M reversely rotates screw 52 to advance and to retract the deadbolt 50, and said motor is mounted by spring means so as to be shifted from a seated condition as and when the deadbolt meets a sufficient obstruction while in the closing mode, so as to depress springs 54 that hold the motor M in its normally seated or mounted position as shown. An actuator 55 from the motor M extends to engage a normally open switch 56 connected by a conductor 57 to one of the three inputs of AND-gate 34 which controls the "open" mode of the deadbolt. Normally, +5 v is supplied to conductor 57 through a current limiting resistor 58 so as to place a high +5 v at the said input of AND-gate 34 while said switch remains released. Consequently, when the motor M is forced to be unseated and shifted axially by a stoppage of the deadbolt, the switch 56 is closed to negative and the said input to AND-gate 34 goes low "0" through conductor 57 and the "open" mode is activated.

Concerning the second mentioned electrical retraction function, the AND-gate 34 is responsive to operation of the ignition switch I of the vehicle to maintain an "open" condition while the vehicle is operating, and to enable a "close" condition when the ignition switch I is "OFF". As shown, this means involves a double pole double throw relay 22 with one set of contacts controlling the conductor 26 from the receiver means 20 to the decoder means 21, and the other set of contacts controlling a conductor 59 to AND-gate 34. The relay magnet is energized through closing of ignition switch I to an "open" mode of the deadbolt. When the ignition switch is "OFF" the relay enables the "close" mode. Accordingly, the relay is de-energized during the "OFF" condition of the ignition switch I, and is energized during the "ON" condition so as to preempt closing of the deadbolt. The relay circuit controlling conductor 59 to the AND-gate 34 normally conducts +5 v to one of the inputs of AND-gate 34 which controls the "open" mode of the deadbolt. Consequently, when the ignition switch I is closed to "ON", the said input to AND-gate 34 goes low"0" and the "open" mode is activated.

From FIG. 4 of the drawings, it will be seen that the double throw switches 44 and 45 are both normally closed to +5 v, however it is normal for the deadbolt to be in either the "open" or "close" position in which case one of said switches is held closed to negative as above described. A feature of this invention is an automatic reverse means in the form of the normally open switch 56 and the resistor 58 which are associated with the limit switch 44 and operable to be closed by the actuator 55 simultaneously or immediately before closing of the limit switch 44. When switch 56 is closed the conductor 57 is grounded and the input to AND-gate 34 goes low"0" so as to condition the motor M into the "open" mode. Release of the "close" mode is then achieved by actuating switch 44 as above described. In this manner the motor operation is sequentially or simultaneously stopped and reversed if and when the deadbolt is jammed or meets with an obstruction.

From the foregoing it will be seen that the electronic code controlled deadbolt herein described is particularly suited for automotive use and is associated with the ignition switch I and operational requirements of the vehicle in which it is to be installed. Such a requirement is that an operating vehicle must be accesible for both ingress and egress, and to this end the circuitry hereinabove described is dependent for its operation upon the condition of the vehicle doors, that is whether they are opened or closed. As shown, electrical energy for the electronics and motor power for the deadbolt is from a power supply 65 from the +12 v battery 23 and producing +5 v with negative taps, and the power supply is supplied only through vehicle door switches 66 in series. When the vehicle doors are open the power supply 65 is disconnected so that the circuitry goes low"0" with the deadbolt in the open position. However, when the vehicle doors are closed the power supply 65 is reconnected so that the circuit is activated with the deadbolt or deadbolts operable to be put in either the "close" or "open" position as circumstances require.

Having described only the typical preferred forms and applications of my invention, I do not wish to be limited or restricted to the specific details herein set forth, but wish to reserve to myself any modifications or variations that may appear to those skilled in the art as set forth within the limits of the following claims.

I claim:

1. An electronic lock system for power positioning of a deadbolt into closed and opened positions in a door jamb including;

a deadbolt, a radio transmitter including a "close" and an "open" encoding means selectively placing distinct tone frequencies on a carrier wave in the form of a "close" code signal or an "open" code signal, a radio receiver including a "close" decoder means responsive to said distinct "close" code signal, an "open" decoder means responsive to said distinct "open" code signal, and logic means separately responsive to the "close" and "open" decoder means and one having a "close" output and the other having an "open" output, switch means comprised of a "close" relay means with a latch logic means responsive to said "close" output for latching into a forward mode, and an "open" relay means with a latch logic means responsive to said "open" output for latching into a reverse mode, a reversible motor drive for moving the deadbolt into either a "close" position or an "open" position in response to either the "close" or "open" mode of the switch means, and a limit switch in circuit to the "close" latch logic means and operated by the deadbolt in the "close" position to release the "close" relay means, and a limit switch in circuit to the "open" latch logic means and operated by the deadbolt in the "open" position to release the "open" relay means.

2. The electronic lock system as set forth in claim 1, wherein the encoder means includes a separate plurality of distinct tone frequency generators producing the "close" and "open" code signals.

3. The electronic lock system as set forth in claim 1, wherein the encoder means includes a plurality of distinct tone frequency generators and one in excess of the number of tone signals in either the "close" or "open" code signals, said one excess tone generator being selectively operative with at least one other of said plurality of tone generators.

4. The electronic look system as set forth in claim 1, wherein the decoder means includes separate decoders and one including at least one decoder means responsive to the "close" code signal and the other including at least one decoder means responsive to the "open" code signal.

5. The electronic lock system as set forth in claim 1, wherein the decoder means includes separate decoders and one including a plurality of decoders responsive to the "close" code signal and the other including a plurality of decoders responsive to the "open" code signal.

6. The electronic lock system as set forth in claim 5, wherein the logic means for the "close" and "open" decoder means is each comprised of an OR-gate selectively responsive thereto.

7. The electronic lock system as set forth in claim 5, wherein the logic means for the "close" and "open" decoder means is each comprised of a network of NAND-gates selectively responsive thereto.

8. The electronic lock system as set forth in claim 1, wherein the decoder means includes a plurality of decoders and one in excess of a number of frequencies comprising the "close" and "open" code signals, the logic means being selectively responsive to said one excess decoder and at least one other decoder.

9. The electronic lock system as set forth in claim 7, wherein the logic means for the "close" and "open" decoder means is comprised of a network of OR-gates selectively responsive thereto.

10. The electronic lock system as set forth in claim 1, wherein the switch means includes an input OR-gate responsive to the "close" output of the decoder means and to an unactuated position of the limit switch to the "close" latch logic means, and includes an input OR-gate responsive to the "open" output of the decoder means and to an unactuated position of the limit switch to the "open" latch logic means.

11. The electronic lock system as set forth in claim 1, wherein the switch means includes an input OR-gate responsive to the "close" output of the decoder means and to a NAND-gate responsive to an unactuated position of the limit switch to the "close" latch logic means, and includes an input OR-gate responsive to the "open" output of the decoder means and to a NAND-gate responsive to an unactuated position of the limit switch to the "open" latch logic means.

12. The electronic lock system as set forth in claim 11, wherein an LED is in circuit with the input of one of the NAND-gates with the latch logic means associated therewith, to indicate forward and reverse modes respectively.

13. The electronic lock system as set forth in claim 1, wherein each latch logic means is comprised of a pair of NAND-gates with the output of one connected to the input of the other, with the input of one responsive to the decoder means output associated therewith and the input of the other responsive to the limit switch associated therewith, and with the output of one to the base of a transistor switched ON and OFF thereby to control a relay switch associated therewith.

14. The electronic lock system as set forth in claim 1, wherein the switch means includes an input OR-gate responsive to the output of each decoder logic means associated therewith and to a NAND-gate responsive to an unactuated position of the limit switch associated therewith, and wherein each latch logic means is comprised of a pair of NAND-gates with the output of one connected to the input of the other, with the input of one responsive to the decoder means output associated therewith and the input of the other responsive to the limit switch associated therewith, and with the output of one to the base of a transistor switched ON and OFF thereby to control a relay switch associated therewith.

15. The electronic lock system as set forth in claim 1, wherein the reversible drive motor is seated by spring means to be unseated by a screw drive into the deadbolt when obstructed in the forward mode to "close", there being an actuator shifted thereby to actuate a reverse switch in circuit to the "open" relay means to set the reverse mode of motor operation.

16. The electronic lock system as set forth in claim 15, wherein a mode conditioning means is controlled by actuation of the reverse switch and is comprised of an AND-gate at the "open" output of the logic means and with inputs from said logic means and from said reverse switch.

17. The electronic lock system as set forth in claim 15, wherein a mode conditioning means is controlled by actuation of the reverse switch and is comprised of a AND-gate at the "open" output of the logic means and with inputs from said logic means and from an ignition switch controlling the operation of a vehicle prime mover.

18. The electronic lock system as set forth in claim 15, wherein a mode conditioning means is controlled by actuation of a reverse switch and is comprised of a three input AND-gate at the "open" output of the logic means and with inputs from said logic means and from said reverse switch and from an ignition switch controlling the operation of a vehicle prime mover.

19. The electronic lock system as set forth in claim 15, wherein a mode conditioning means is controlled by actuation of a reverse switch and is comprised of a three input AND-gate at the "open" output of the logic means and with inputs from said logic means and from said reverse switch and from an ignition switch controlling the operation of a vehicle prime mover, and wherein a normally open switch is closed by each door of a vehicle and is a series circuit to a power supply energizing the electronic lock system.

20. The electronic lock system as set forth in claim 1, wherein the reversible drive motor is seated by spring means to be unseated by a screw drive into the deadbolt when obstructed in the forward mode to "close", there being an actuator shifted thereby to actuate the "close" limit switch to stop the forward mode of motor operation.

21. The electronic lock system as set forth in claim 1, wherein the reversible drive motor is seated by spring means to be unseated by a screw drive into the deadbolt when obstructed in the forward mode to close, there being an actuator shifted thereby to actuate the "close" limit switch to stop the forward mode of motor operation, and to octuate a reverse switch in circuit to the "open" relay means to set the reverse mode of motor operation.

22. The electronic lock system as set forth in claim 1, wherein a mode conditioning means is comprised of a AND-gate at the "open" output of the logic means and with inputs from said logic means and from an ignition switch controlling the operation of a vehicle prime mover and disconnecting the logic means when in an "ON" position.

23. The electronic lock system as set forth in claim 1, wherein an ignition switch controlling the operation of a vehicle prime mover disconnects the logic means when in an "ON" position.

24. The electronic lock system as set forth in claim 1, wherein an ignition switch controlling the operation of a vehicle prime mover energizes a relay when in an "ON" position to disconnect the logic means, and wherein a mode conditioning means is comprised of a AND-gate at the "open" output of the logic means and with inputs from said logic means and from said relay ensure an "open" mode when the ignition switch is "ON".

25. The electronic lock system as set forth in claim 1, wherein a normally open switch is closed by each door of a vehicle and in a series circuit to a power supply energizing the electronic lock system.

* * * * *